US009923295B2

(12) United States Patent
Fujimura

(10) Patent No.: US 9,923,295 B2
(45) Date of Patent: Mar. 20, 2018

(54) CONNECTOR

(71) Applicant: Sumitomo Wiring Systems, Ltd., Yokkaichi, Mie (JP)

(72) Inventor: Mizuho Fujimura, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/542,664

(22) PCT Filed: Dec. 24, 2015

(86) PCT No.: PCT/JP2015/085923
§ 371 (c)(1),
(2) Date: Jul. 11, 2017

(87) PCT Pub. No.: WO2016/114086
PCT Pub. Date: Jul. 21, 2016

(65) Prior Publication Data

US 2017/0352974 A1 Dec. 7, 2017

(30) Foreign Application Priority Data

Jan. 14, 2015 (JP) ..... 2015-004990

(51) Int. Cl.
*H01R 13/514* (2006.01)
*H01R 13/42* (2006.01)
(Continued)

(52) U.S. Cl.
CPC ..... *H01R 13/42* (2013.01); *H01R 13/055* (2013.01); *H01R 13/514* (2013.01);
(Continued)

(58) Field of Classification Search
CPC ..... H01R 13/4362; H01R 13/4223
(Continued)

(56) References Cited

U.S. PATENT DOCUMENTS 4,946,399 A * 8/1990 Kawashima ..... H01R 13/4362 29/842
5,782,657 A * 7/1998 Wolla ..... H01R 13/4362 439/595
(Continued)

FOREIGN PATENT DOCUMENTS

JP 2002-313473 10/2002
JP 2007-311347 11/2007
JP 2009-43648 2/2009

OTHER PUBLICATIONS

International Search Report dated Mar. 1, 2016.

*Primary Examiner* — Phuong Chi T Nguyen
(74) *Attorney, Agent, or Firm* — Gerald E. Hespos; Michael J. Porco; Matthew T. Hespos

(57) ABSTRACT

A connector includes a connector housing (10) with a cavity (15B), into which a terminal fitting (40) is to be inserted. The connector housing (10) is connectable to a mating connector. A retainer insertion opening (30) opens in a side surface of the connector housing (10) and in a direction intersecting an inserting direction of the terminal fitting (40). A retainer (50) can be inserted into the retainer insertion opening to lock the terminal fitting (40). The retainer (50) includes a thin plate (61) extending in an inserting direction of the retainer (50), a convex portion (70) on a lower surface of the thin plate (61) and a groove (71) in the convex portion (70). A projection (25) is provided on a rear part of a locking lance (20) in the cavity (15B) of the connector housing (10) and fits to the groove (71).

2 Claims, 16 Drawing Sheets

(51) Int. Cl.

| | |
|---|---|
| ***H01R 13/641*** | (2006.01) |
| ***H01R 13/627*** | (2006.01) |
| ***H01R 13/629*** | (2006.01) |
| ***H01R 13/05*** | (2006.01) |

(52) U.S. Cl.
CPC ..... *H01R 13/627* (2013.01); *H01R 13/629* (2013.01); *H01R 13/6276* (2013.01); *H01R 13/641* (2013.01); *H01R 13/62927* (2013.01)

(58) Field of Classification Search
USPC ..... 439/439, 752, 595, 744, 871
See application file for complete search history.

(56) References Cited

U.S. PATENT DOCUMENTS

| | | | | |
|---|---|---|---|---|
| 8,550,845 | B1 * | 10/2013 | Osterhart ..... | H01R 13/4365 439/595 |
| 2002/0168895 | A1 * | 11/2002 | Suzuki ..... | H01R 13/4365 439/595 |
| 2002/0173198 | A1 * | 11/2002 | Plate ..... | H01R 13/4362 439/489 |
| 2007/0275609 | A1 | 11/2007 | Lamdiziz et al. | |
| 2009/0035980 | A1 | 2/2009 | Nakamura | |

* cited by examiner

CONNECTOR

BACKGROUND

1. Field of the Invention

This specification relates to a connector.

2. Description of the Related Art

A connector of a side retainer type has a connector housing formed with cavities and a retainer insertion opening formed in a side surface of the connector housing. A retainer is inserted through this retainer insertion opening and is provided with a locking protrusion capable of locking a step portion or the like of a terminal fitting. The connector may have a plurality of cavities are arranged separately in a plurality of stages. Thus, the retainer is formed into a lattice shape in many cases. On the other hand, the miniaturization of connectors has been required increasingly. Cavities may be arranged densely to achieve miniaturization. However, densely arranged cavities may complicate forming the retainer into a lattice shape. In this case, the retainer has a shape obtained by removing vertical frame pieces of a lattice, i.e. such a shape that horizontal arms corresponding to each stage of the cavities are arranged in parallel. Thus, only both ends of the arms are coupled and locking protrusions are provided on each arm.

However, the retainer that is shaped as described above may have long arms that may curve and deform since there is no support conventionally given by the vertical frame pieces. To solve such a problem, Japanese Unexamined Patent Publication No. 2002-313473, forms guide grooves in front and rear surfaces of arms, whereas continuous ribs to be slidably fit into the guide grooves are formed on side walls of a retainer insertion opening facing the front and rear surfaces of the arms. Curving deformation of the retainer can be prevented by fitting the ribs on the connector housing side and the grooves on the retainer side.

However, due to a request for further miniaturization, it may not be possible in some cases to form continuous guide grooves and ribs as in the connector shown in Japanese Unexamined Patent Publication No. 2002-313473.

SUMMARY

A connector disclosed in this specification includes a connector housing provided with a cavity, into which a terminal fitting is to be insertable. The connector is connectable to a mating connector. A retainer insertion opening is provided in a side surface of the connector housing and is open in a direction intersecting with an inserting direction of the terminal fitting. A retainer is to be inserted into the retainer insertion opening to lock the terminal fitting. The retainer includes a thin plate extending in an inserting direction of the retainer. A convex portion is provided on a lower surface of the thin portion and a groove is provided in the convex portion. A projection is provided on a rear end part of a locking lance provided in the cavity of the connector housing and can fit in the groove. According to this configuration, the deflection of the thin plate can be suppressed by fitting the groove and the projection even if a continuous guide groove and rib cannot be formed.

The connector housing may be formed with the cavities such that terminal fittings of two or more sizes are arranged in a plurality of stages. A rear end part of the locking lance for locking a large-size terminal fitting larger than a smallest terminal fitting may project more toward the retainer than the locking lances for locking the other terminal fittings. A dimension of the thin plate in the inserting direction of the terminal fittings may be smaller than that of other parts of the retainer in the inserting direction of the terminal fittings to avoid the locking lance for locking the large-size terminal fitting. According to this configuration, the use of such a structure is further preferable since the thin plate has a small width and is deflected easily.

According to the connector disclosed in this specification, it is possible to suppress the curving deformation of a retainer also in a miniaturized connector.

DETAILED DESCRIPTION

An embodiment is described with reference to FIGS. 1 to 16.

Figure 1:
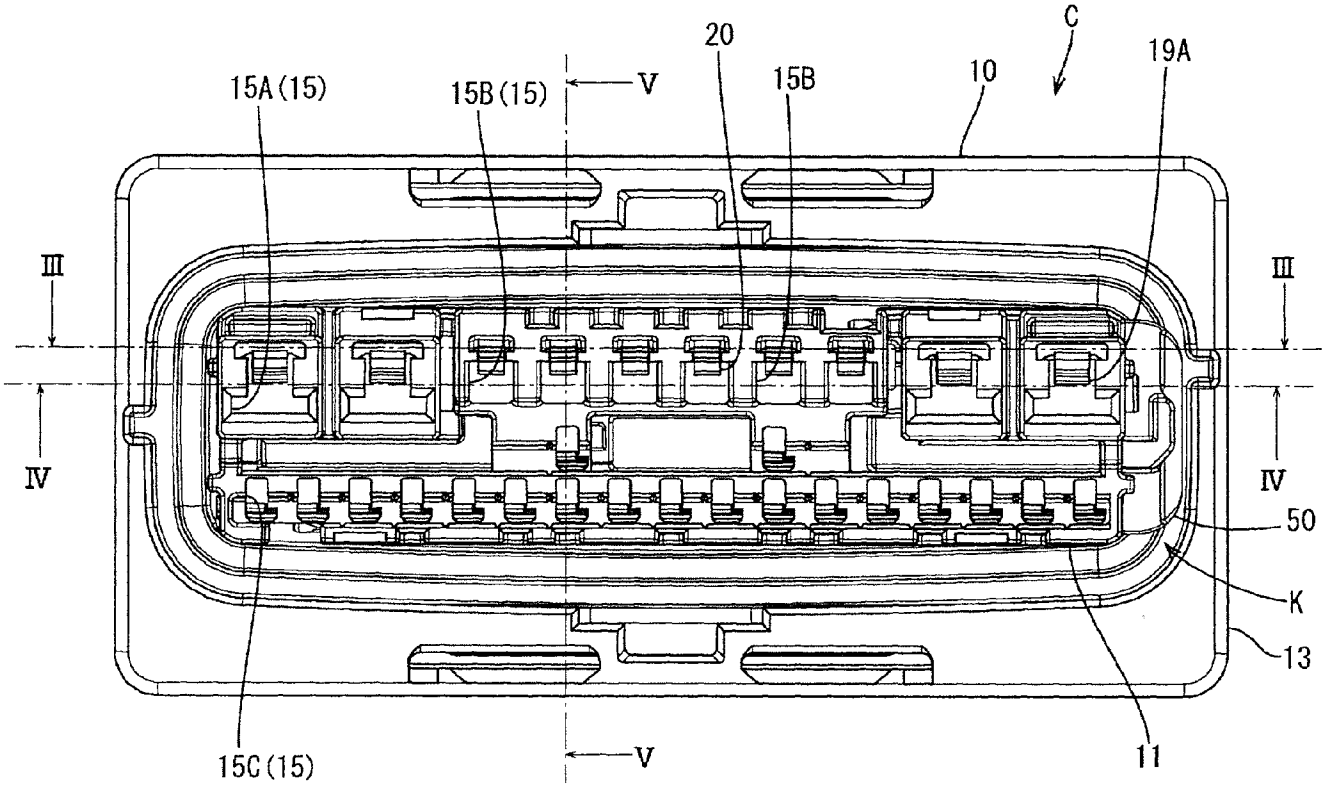
FIG. 1 is a front view of a connector at a partial locking position according to an embodiment.
Figure 2:
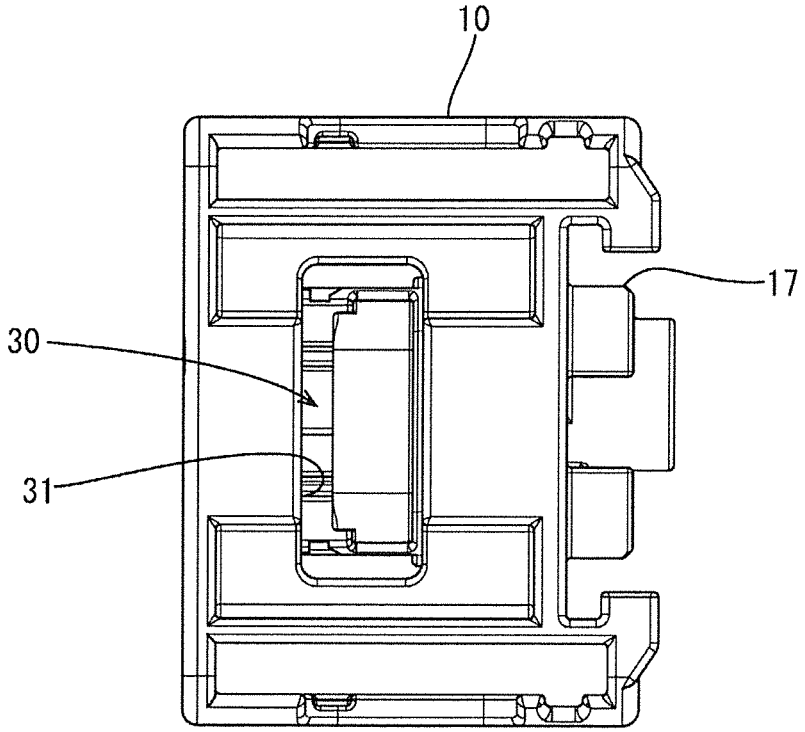
FIG. 2 is a right side view of the connector.

A connector C of this embodiment includes a female connector housing 10 and a side retainer 50 to be mounted into the connector housing 10 as shown in FIG. 1. In the following description, a connecting direction and a separating direction of the connector C and a mating connector are referred to as a forward direction and a rearward direction concerning a front-rear direction, and a vertical direction is based on FIG. 1.

The connector housing 10 is made of synthetic resin and shaped to be long in a lateral direction. Further, as shown in FIG. 1, the connector housing 10 includes a connector housing body 11 formed with cavities 15 capable of accommodating terminal fittings, and an outer peripheral portion 13 in the form of a rectangular tube provided on the outer periphery of the connector housing body 11. A connection space K into which the mating connector is inserted at the time of connection is defined between the connector housing body 11 and the outer peripheral portion 13.

Each cavity 15 is provided in the connector housing body 11 and is open in the connecting direction (both forward and rearward directions). The terminal fitting is insertable into the cavity 15 from behind (side opposite to a connection surface), and a mating terminal fitting accommodated in the mating connector is insertable into the cavity 15 from the front, i.e. from the side of the connection surface. As shown in FIG. 1, three types of cavities 15 differing in size are provided. More particularly, large-size cavities 15A are arranged side by side in upper parts of both end parts of a long side (lateral direction) of the connector housing body 11, medium-size cavities 15B for accommodating medium-size terminal fittings are arranged in an area between the large-size cavities 15A, and small-size cavities 15C for accommodating small-size terminal fittings are arranged below the medium-size and large-size cavities 15B, 15A. Note that, in the following description, the cavities 15A to 15C are referred to as the cavities 15 when a common configuration is described.

Figure 5:
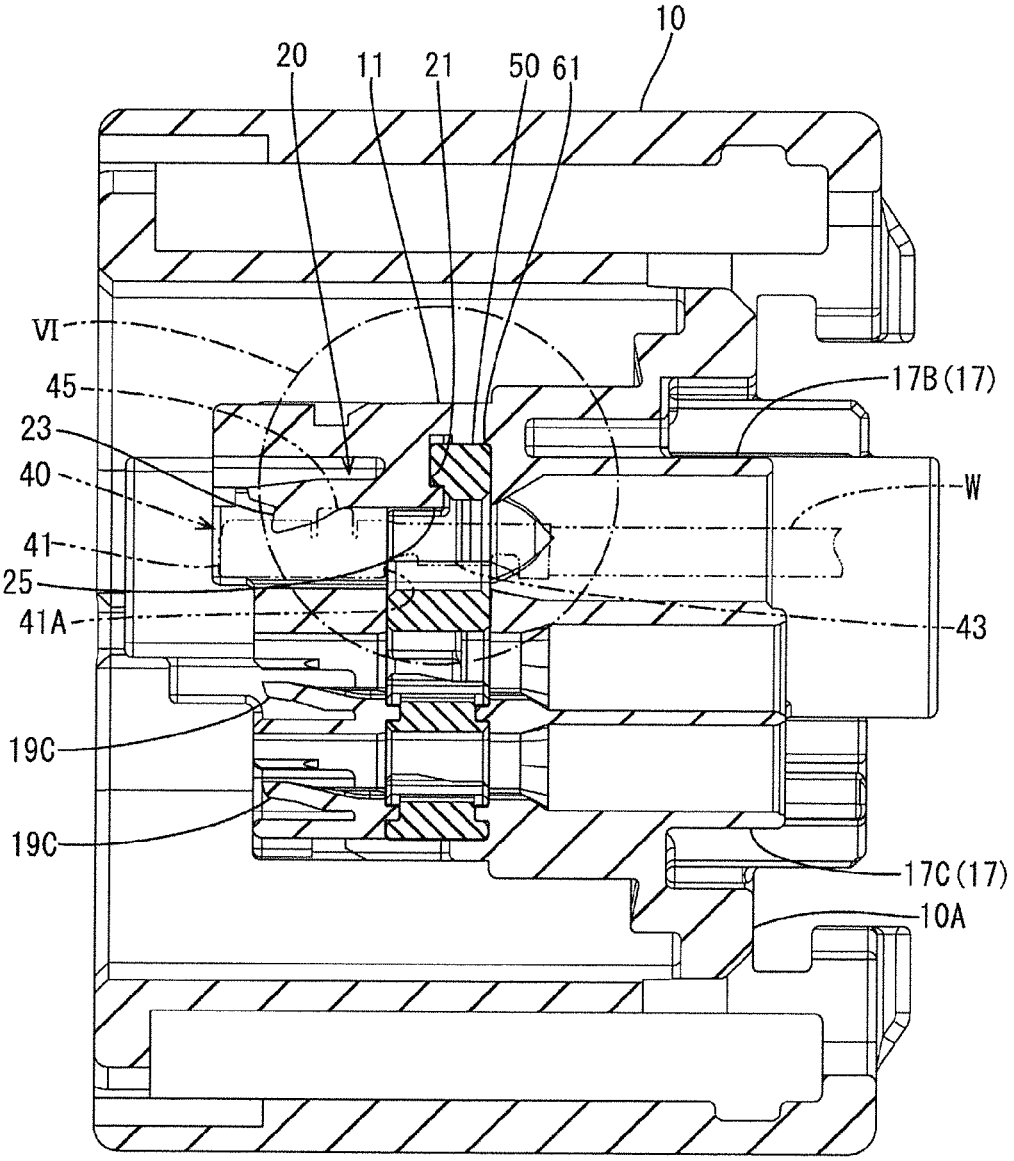
FIG. 5 is a section along V-V in FIG. 1.
Figure 12:
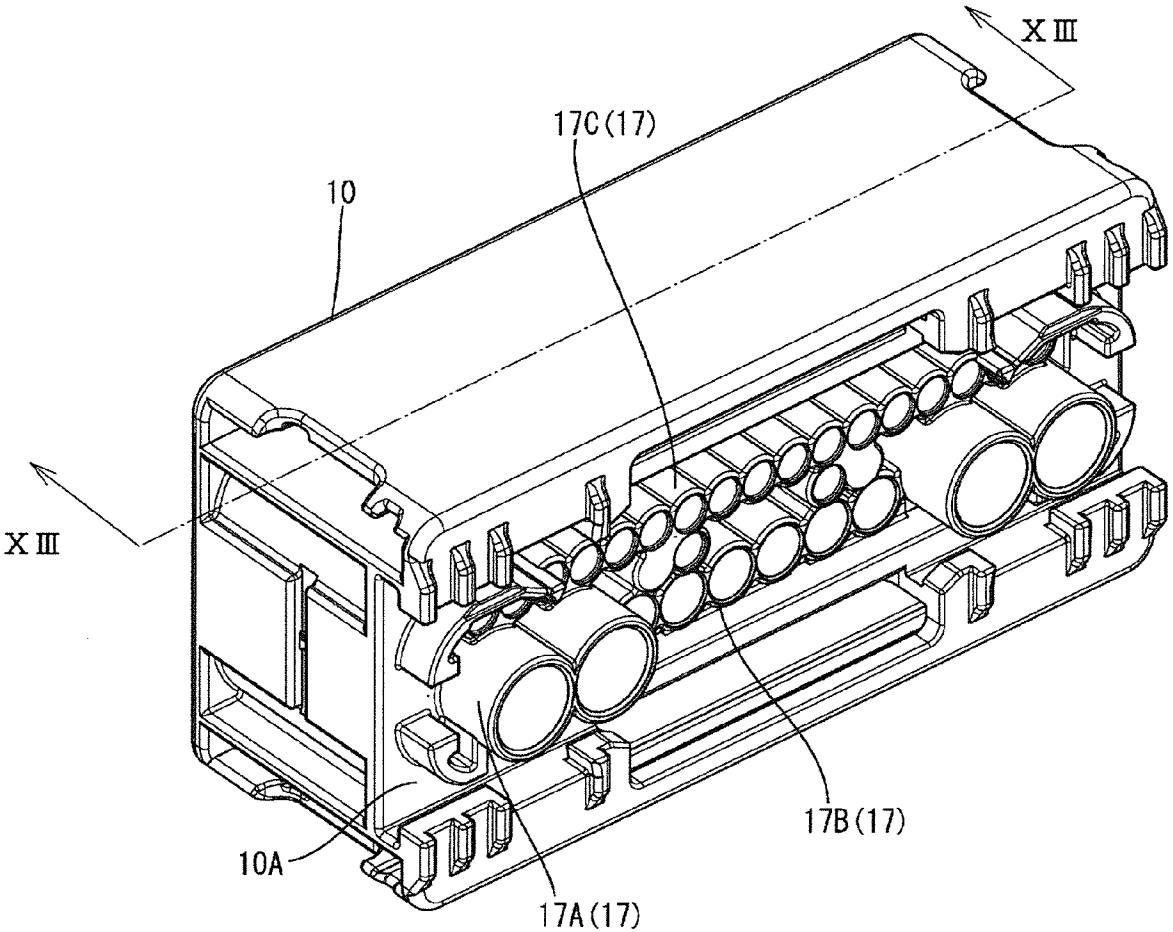
FIG. 12 is a perspective view of the connector housing.

As shown in FIGS. 5, 12 and the like, cylindrical wire accommodating tubes 17 project from a rear surface 10A of the connector housing 10 at positions corresponding to the positions of the cavities 15. The inner surface of each wire accommodating tube 17 is widened from and continuous with the inner surface of the respective cavity 15. Similarly to the cavities 15, three types of wire accommodating tubes 17 differing in size also are provided. The wire accommodating tubes 17A to 17C are provided in accordance with the respective cavities 15A to 15C.

As shown in FIG. 1, a large-size locking lance 19A for primarily locking the large-size terminal fitting is provided to be deflectable and deformable upwardly on the ceiling surface of each large-size cavity 15A. Further, as shown in FIGS. 1, 5 and the like, a small-size locking lance 19C for primarily locking the small-size terminal fitting is provided to be deflectable and deformable downwardly on the bottom surface of each small-size cavity 15C. Furthermore, a cantilevered medium-size locking lance 20 is provided on the ceiling surface of the medium-size cavity 15B.

Figure 8:
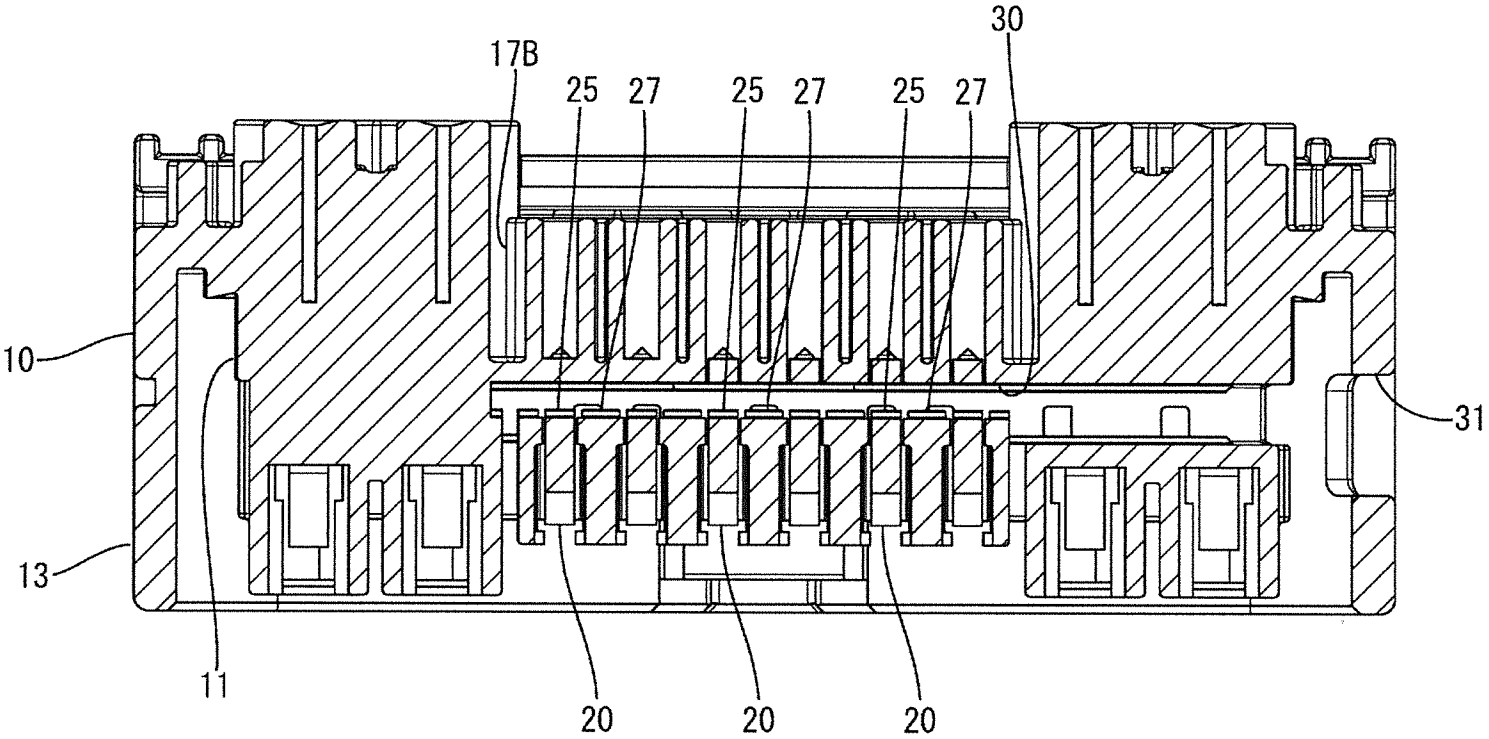
FIG. 8 is a section of a connector housing at the same position as in FIG. 3.

As shown in FIG. 5, the medium-size locking lance 20 includes a base end portion 21 continuous with the ceiling surface of the medium-size cavity 15B, a deflectable and deformable lance locking portion 23 provided forward of the base end portion 21 and a projection 25 flush with the lower surface of the lance locking portion 23 and projecting rearward from the base end portion 21. The lance locking portion 23 primarily locks the medium-size terminal fitting 40 by locking a connecting portion 41 of the medium-size terminal fitting 40 to be described later. As shown in FIG. 8, the projection 25 has the same width as the lance locking portion 23 and the base end portion 21. By providing the projection 25 continuous with the medium-size locking lance 20 in this way, the rigidity of the medium-size locking lance 20 is improved. Note that the base end portion 21 of the medium-size locking lance 20 is behind the base end of the medium-size locking lance 19C.

Figure 13:
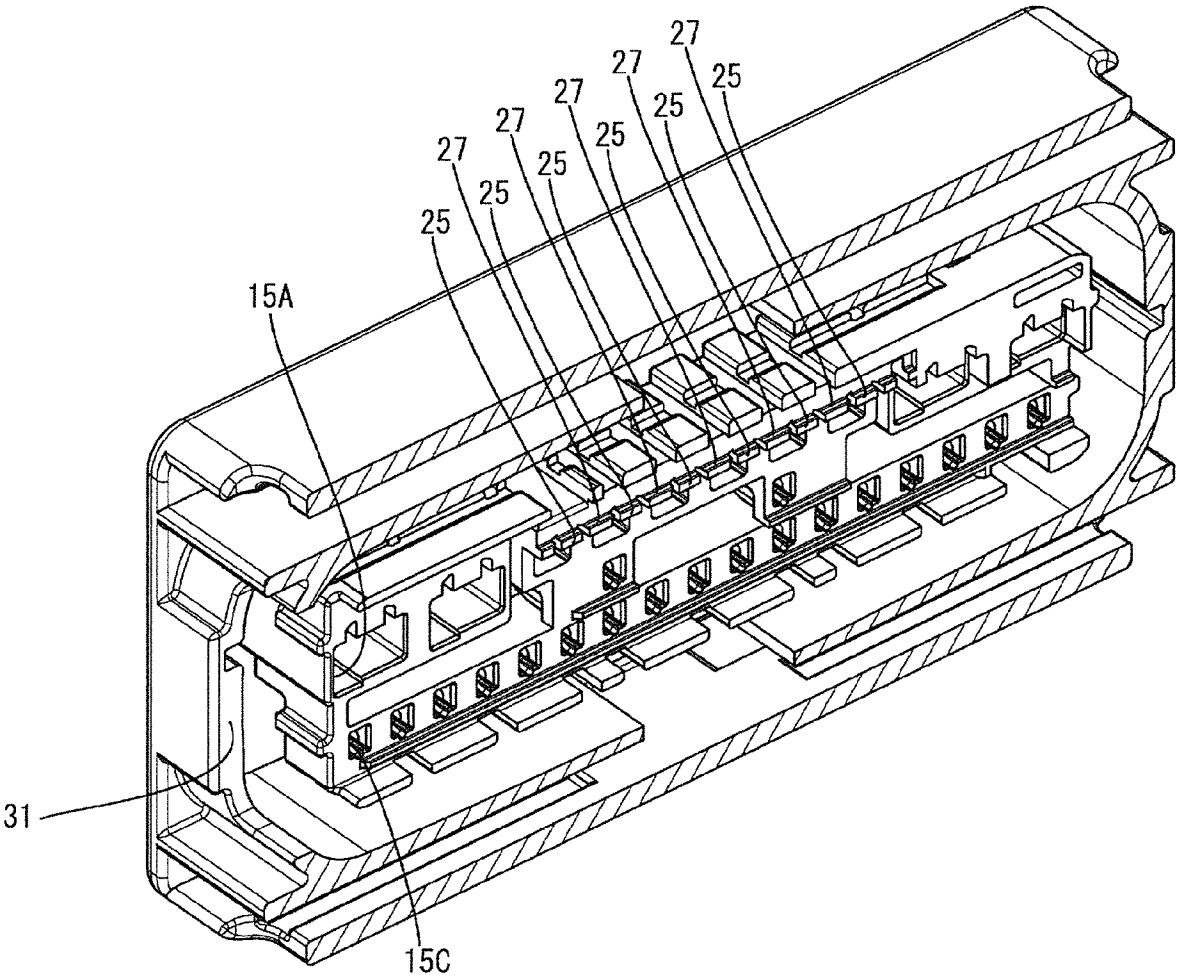
FIG. 13 is a section along XIII-XIII in FIG. 12.

As shown in FIGS. 8 and 13, separation wall projections 27 are provided between a plurality of projections 25 on a wall surface facing the retainer insertion opening 30 to be described later, and tiny clearances are defined between the separation wall projections 27 and the projections 25. Each separation wall projection 27 projects rearward from a separation wall provided between the medium-size cavities 15B. Further, each separation wall projection 27 has the same rearward projecting dimension and projecting height as the projection 25 of the medium-size locking lance 20.

As shown in FIG. 5, the medium-size terminal fitting 40 includes the connecting portion 41 in the form of a rectangular tube to be connected to a mating terminal, and crimped to an end of a wire W by swaging a barrel 43 at a rear end. The connecting portion 41 is formed with a locked portion to which the medium-size locking lance 20 is lockable, and a rear edge 41A of the lower surface of the connecting portion 41 is lockable to the side retainer 50 to be described later. Further, the connecting portion 41 is provided with posture holding portions 45 for holding an insertion posture of the medium-size terminal fitting 40, and these posture holding portions 45 pass along both sides of the base end portion 21 of the medium-size locking lance 20.

Figure 14:
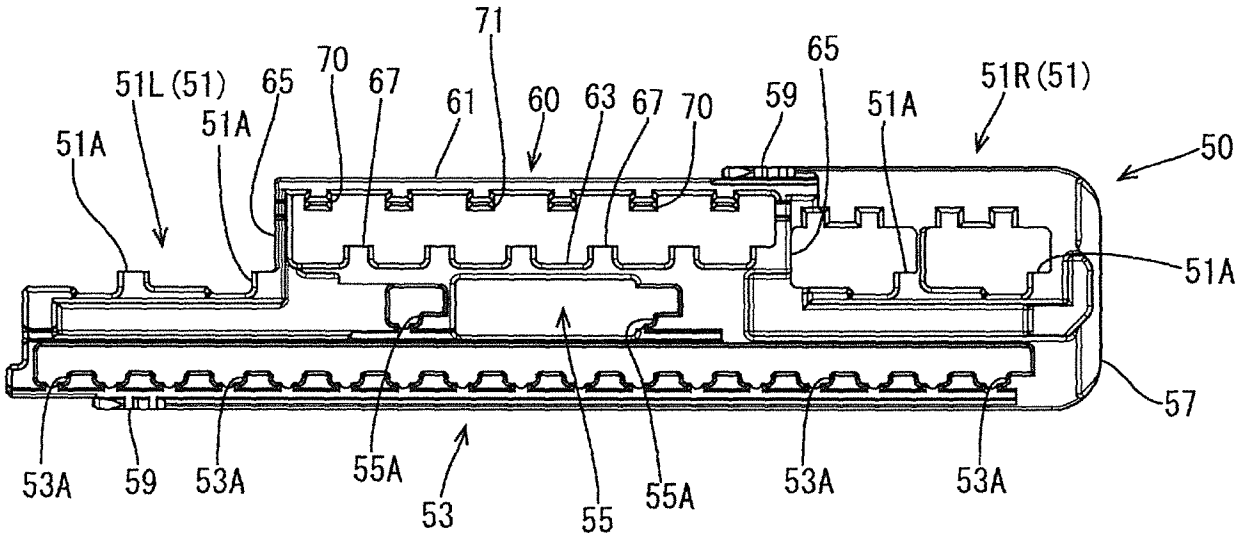
FIG. 14 is a front view of a side retainer.
Figure 15:
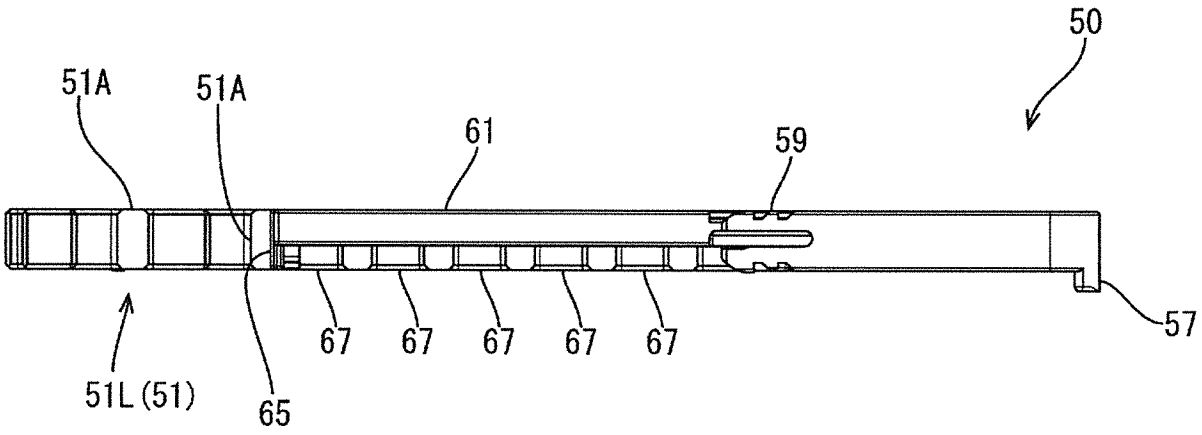
FIG. 15 is a plan view of the side retainer.
Figure 16:
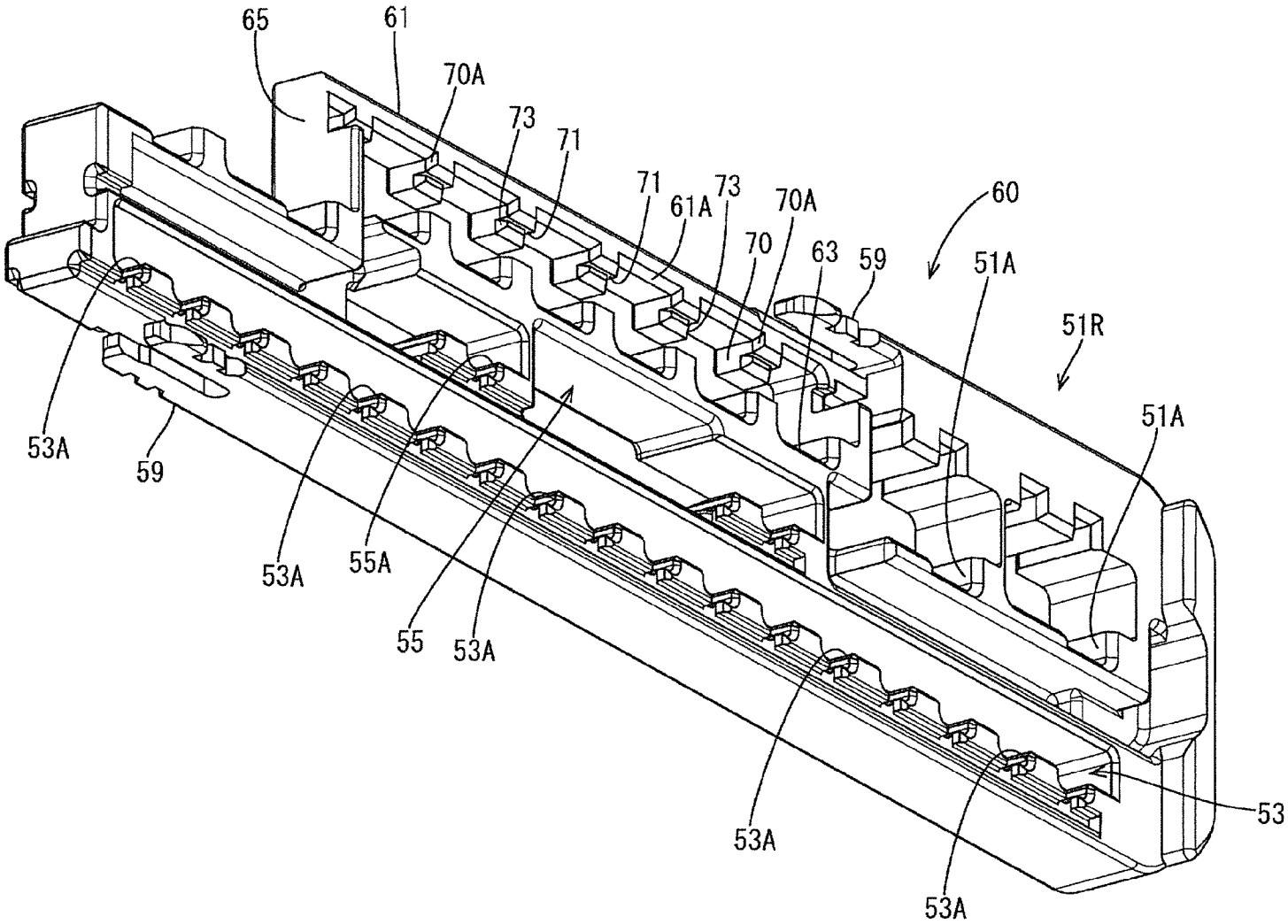
FIG. 16 is a perspective view of the side retainer.

The side retainer 50 is mountable into the connector housing 10 for doubly locking each terminal fitting. This side retainer 50 is made of synthetic resin and roughly has a substantially rectangular shape long in the lateral direction, as shown in FIGS. 14 to 16. The side retainer 50 includes large-size terminal locking portions 51 provided on upper parts of both left and right ends, a first small-size terminal locking portion 53 provided on a lower part, a second small-size terminal locking portion 55 provided above the first small-size terminal locking portion 53 and between the left and right large-size terminal locking portions 51, and a medium-size terminal locking portion 60 provided between the left and right large-size terminal locking portions 51 on an uppermost part.

The left and right large-size terminal fitting locking portions 51 have different shapes in FIG. 14, the left large-size terminal locking portion 51 of FIG. 14 is denoted by 51L and the right large-size terminal locking portion 51 of FIG. 14 is denoted by 51R. The left large-size terminal locking portion 51L has only a lower part and is shaped in conformity with the shape of the lower surfaces of the large-size cavities 15A. Large-size terminal locking protrusions 51A are provided on right sides of parts corresponding to the respective large-size cavities 15A. These large-size terminal locking protrusions 51A secondarily lock the large-size terminal fittings when the side retainer 50 is at a full locking position. Holes are open on the right large-size terminal locking portion 51 to correspond to the respective large-size cavities 15A, and the large-size terminal locking protrusions 51A are provided on right sides of these holes.

First small-size terminal locking protrusions 53A for locking the small-size terminal fittings are formed at the same intervals as the small-size cavities 15C on a laterally extending bottom piece of the first small-size terminal locking portion 53. An arm is provided between the first and second small-size terminal locking portions 53 and 55, and vertical frame pieces are provided on both left and right sides between this arm and the bottom piece. Holes are open on the second small-size terminal locking portion 55 at positions corresponding to the small-size cavities 15C and second small-size terminal locking protrusions 55A are provided on right sides of these holes.

As shown in FIGS. 14 and 16, the medium-size terminal locking portion 60 extends in the lateral direction and includes a thin plate 61 thin in the vertical direction, a bottom plate 63 serving as a boundary between the second small-size terminal locking portion 55 and the medium-size terminal locking portion 60, side walls 65 linking the thin plate 61 and the second small-size terminal locking portion 55 and convex portions 70 provided on the lower surface of the thin plate 61. Further, medium-size terminal locking protrusions 67 for locking the rear edges 41A of the lower surfaces of the connecting portions 41 of the medium-size terminal fittings 40 are formed at the same intervals as the medium-size cavities 15B on the bottom plate 63.

As shown in FIGS. 5 and 15, a dimension in the front-rear direction of the thin plate 61 (dimension in an inserting direction of the terminal fittings) is substantially about half those of the other parts of the side retainer 50. The thin plate 61 has such a dimension in the front-rear direction because the rear ends of the medium-size locking lances 20 are arranged at the same height position as the thin plate 61 in the vertical direction and the medium-size locking lances 20 extend more rearward than the small-size locking lances 19C. Thus, the thin plate 61 easily is deflected down by its own weight. Further, the lower edge of a front end part of the thin plate 61 is formed into an inclined surface 61, as shown in FIG. 16.

Figure 6:
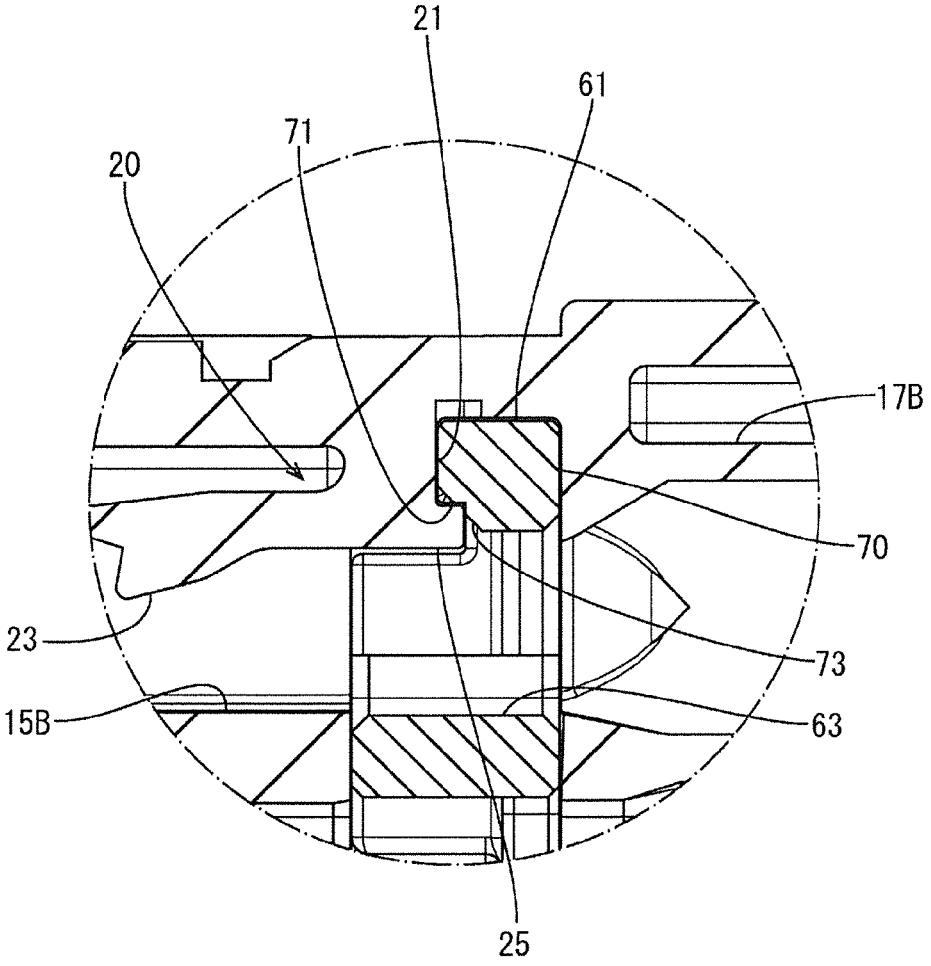
FIG. 6 is a partial enlarged section at a position V1 in FIG. 5.
Figure 7:
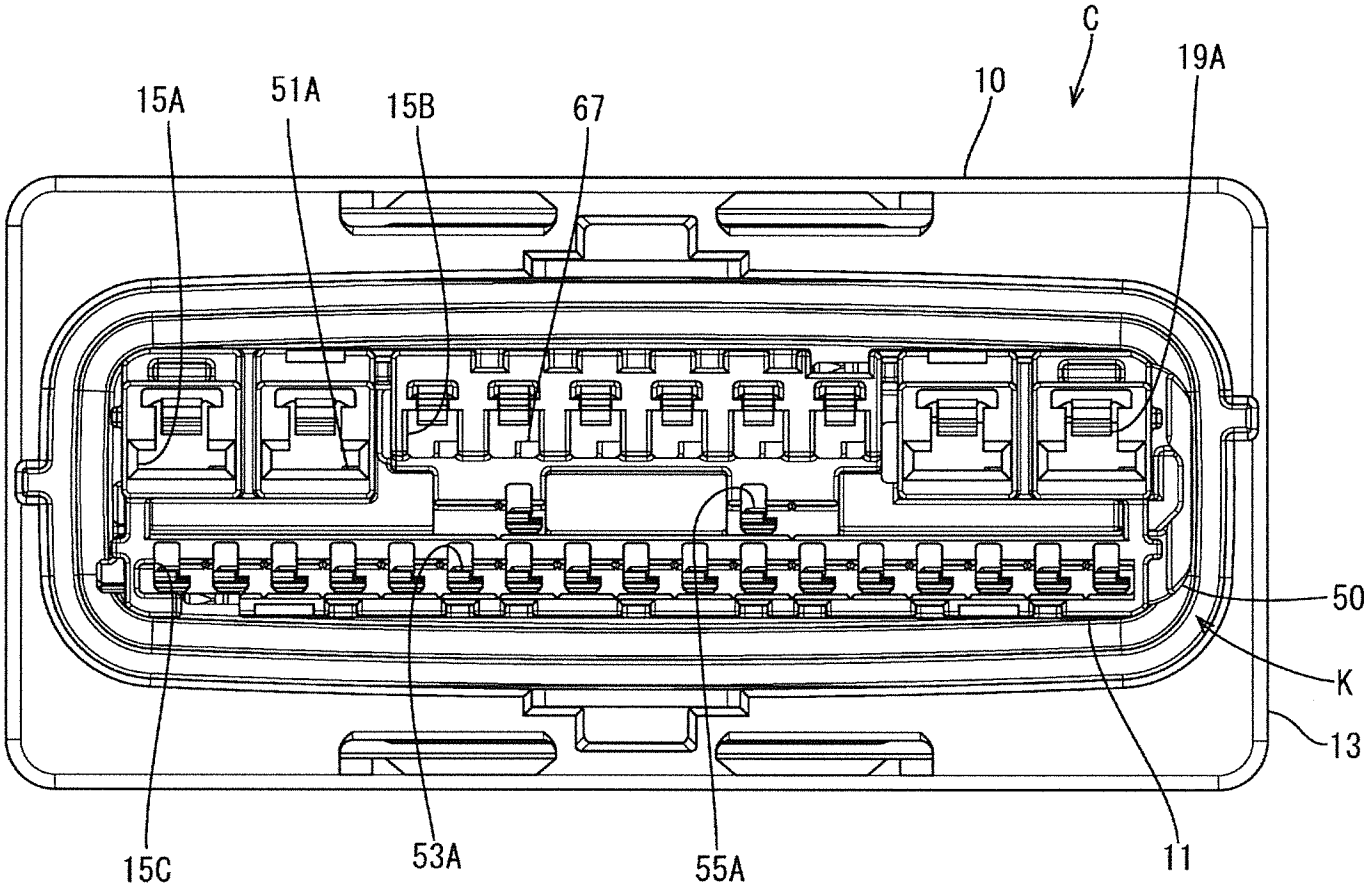
FIG. 7 is a front view of the connector at a full locking position.

As shown in FIGS. 14 and 16, the convex portions 70 provided on the lower surface of the thin plate 61 have the same dimension in the front-rear direction as the thin plate 61. The convex portions 70 are arranged between the medium-size terminal locking protrusions 67. Further, as shown in FIGS. 5 and 6, the lower end position of the convex portion 70 is slightly above the lower end position of the medium-size locking lance 20 and the lower end position of the inner surface of the wire accommodating tube 17B. The convex portions 70 project down from the thin plate 61 in this way, whereby the convex portions 70 function as a ceiling surface in the retainer insertion opening 30 to be described later. Further, as shown in FIG. 16, the right side surface of a front end upper portion 70A of the convex portion 70 is formed into such an inclined surface narrowed toward the front, and the lower surface thereof is formed into an inclined surface parallel to the inclined surface 61A of the thin plate portion 61.

Further, as shown in FIGS. 6 and 16, a groove 71 is provided by rectangularly cutting a corner part between the front and lower surfaces of the convex portion 70. A tapered portion 73 is provided behind the groove 71. The tapered portion 73 is provided on a front side of a lower part of the convex portion 70 where the groove 71 is formed, and the left and right side surfaces and lower surface thereof are formed into inclined surfaces to become smaller toward the front end surface. The groove 71 is engageable with the projection 25 at a partial locking position of the side retainer 50, and engageable with the separation wall projection 27 at the full locking position of the side retainer 50 (see FIGS. 13 and 16).

Note that an operating portion 57 used to insert and withdraw the side retainer 50 is formed on the right end of the side retainer 50 in FIG. 14. Further, retainer locking portions 59 provided with locking grooves for locking at the partial locking position and the full locking position with respect to the connector housing 10 are provided on an upper end part and a lower end part of the side retainer 50.

Figure 3:
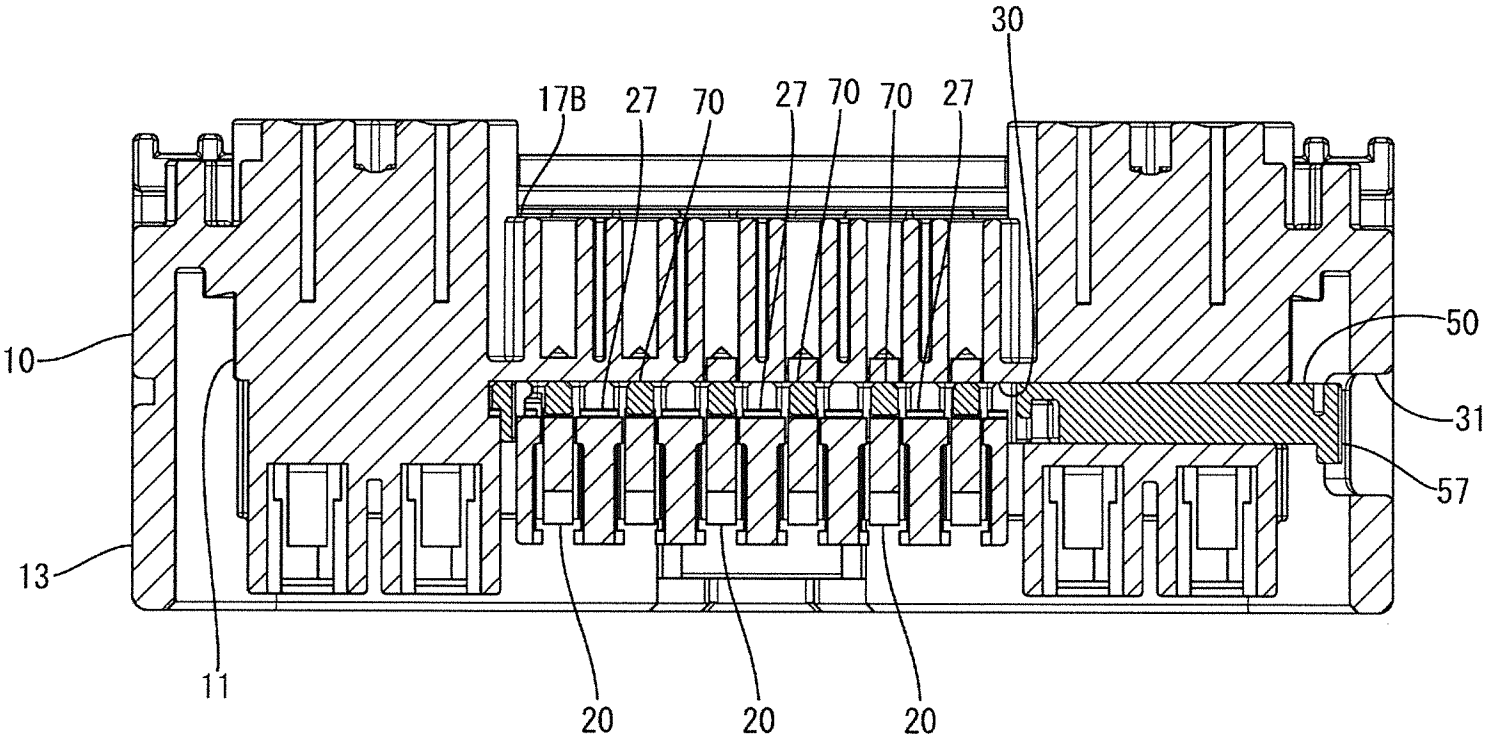
FIG. 3 is a section along III-III in FIG. 1.
Figure 4:
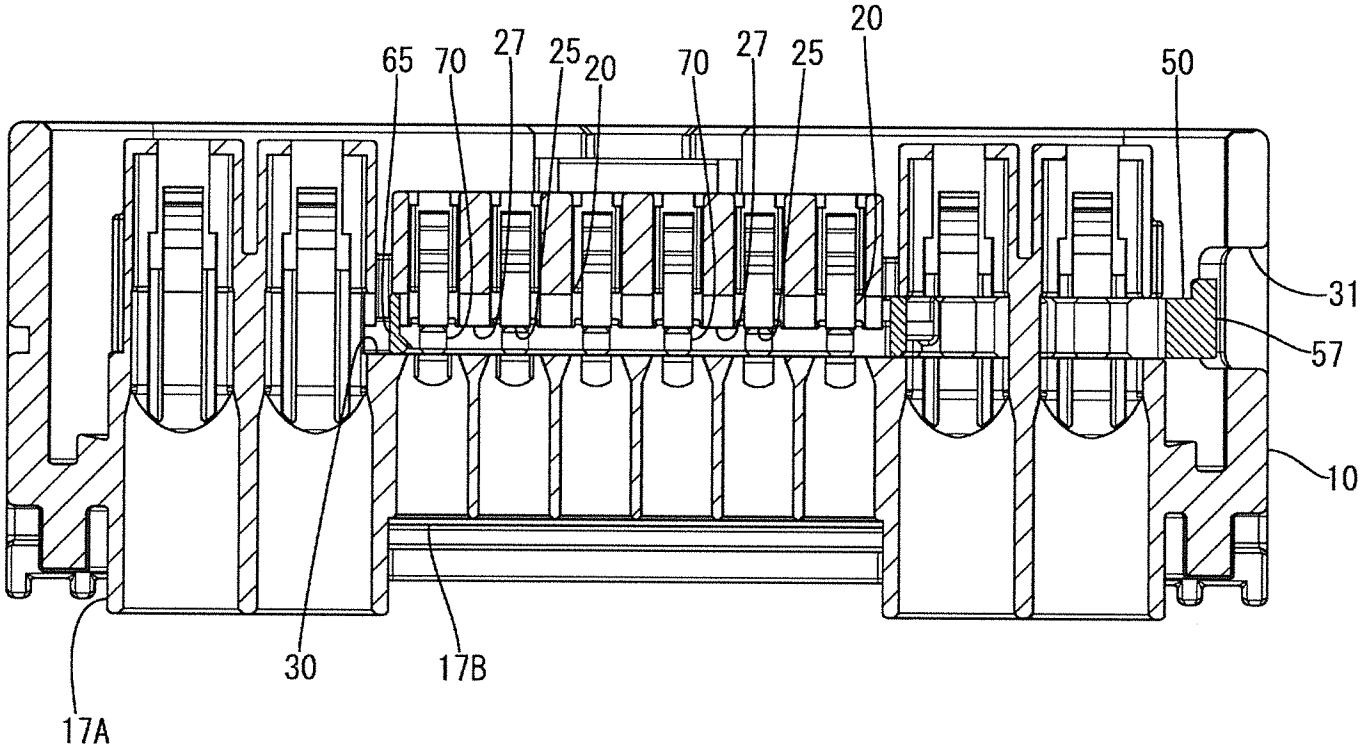
FIG. 4 is a section along IV-IV in FIG. 1.
Figure 9:
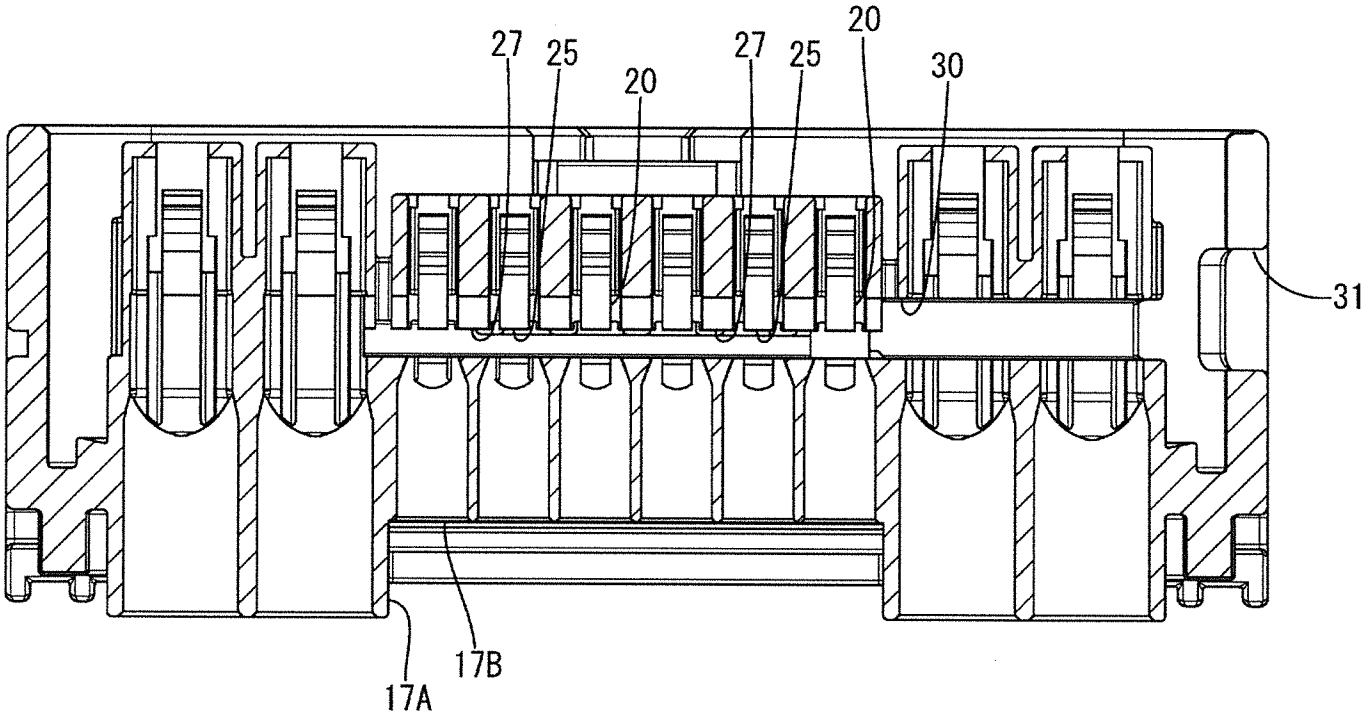
FIG. 9 is a section of the connector housing at the same position as in FIG. 4.
Figure 10:
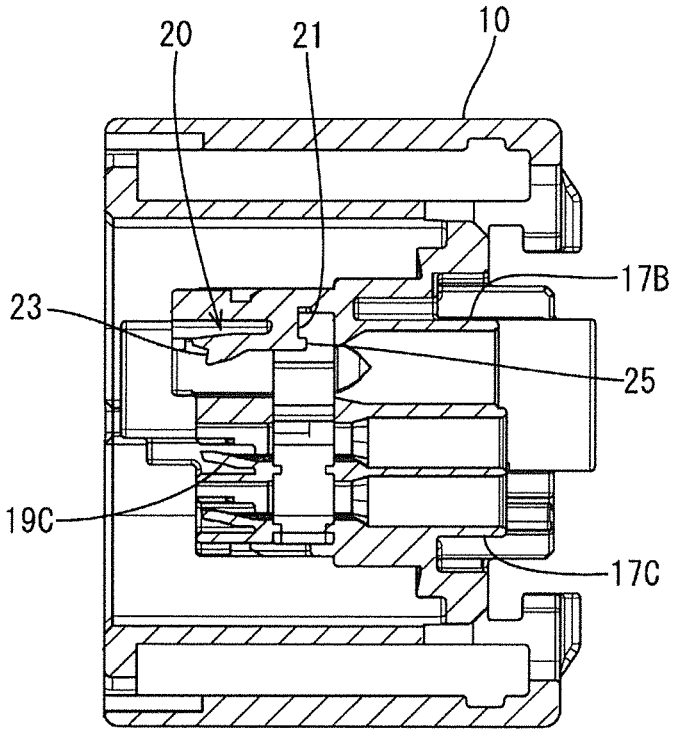
FIG. 10 is a section of the connector housing at the same position as in FIG. 5.
Figure 11:
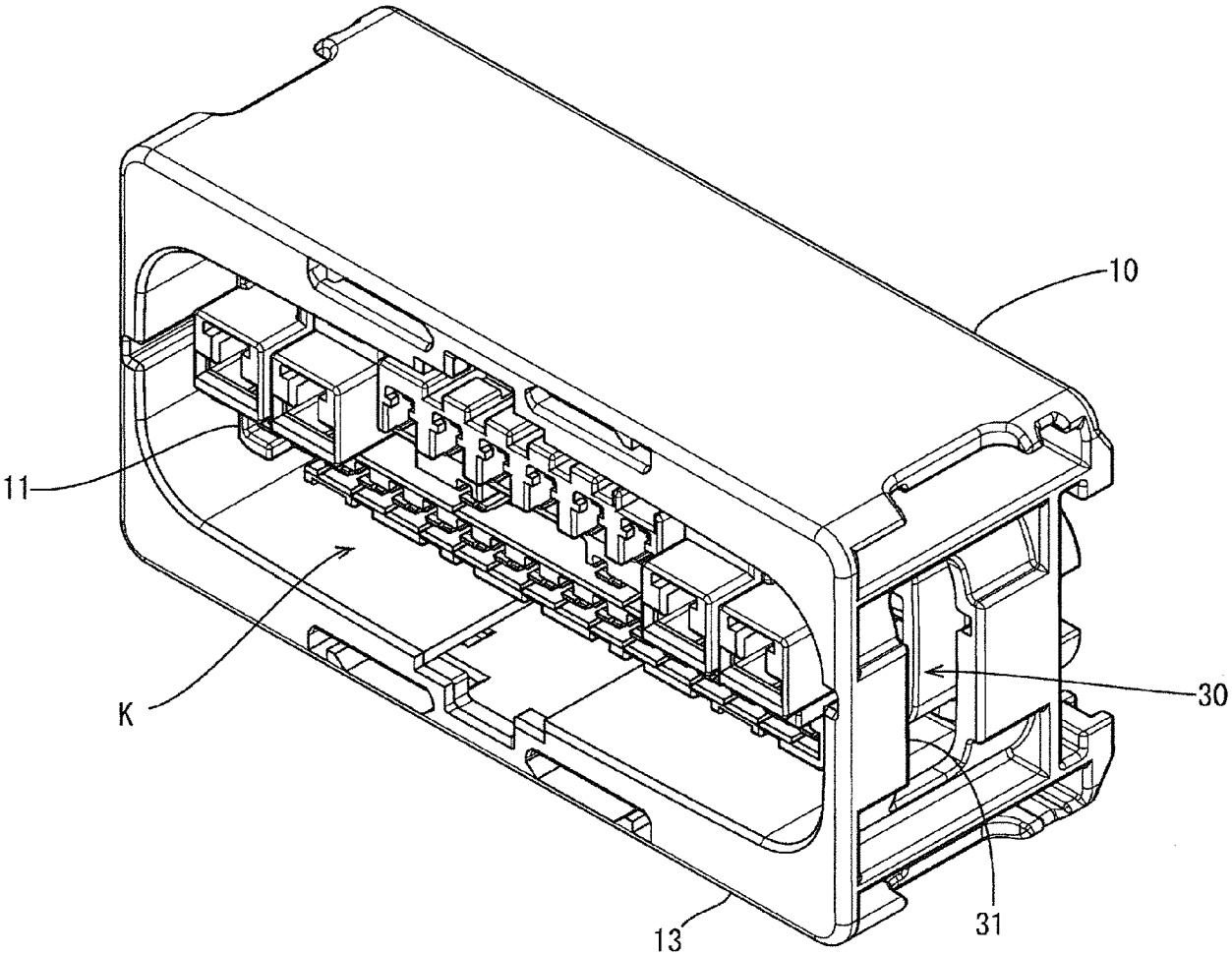
FIG. 11 is a perspective view of the connector housing.

On the other hand, the retainer insertion opening 30 into which the side retainer 50 described above is insertable is formed at an intermediate position of the connector housing 10 in the front-rear direction, specifically slightly behind a position where the locking lances 19A, 19C and 20 are formed, to cross in a direction intersecting with the inserting direction of the terminal fittings as shown in FIGS. 3 and 9. An entrance 31 is open on a right side of the retainer insertion opening 30 when viewed from the front.

This embodiment is structured as described above. Next, a mounting procedure of the side retainer 50 is described. The side retainer 50 is inserted through the entrance 31 of the retainer insertion opening 30. At this time, since the front end upper portions 70A and the tapered portions 73 of the convex portions 70 of the side retainer 50 have the inclined surfaces, the inclined surfaces serve as guides for the projections 25 and the separation wall projections 27, whereby the side retainer 50 is inserted smoothly. The retainer locking portions 59 are locked at the partial locking position inside the retainer insertion opening 30 when the pushing of the side retainer 50 approaches a final stage so that the side retainer 50 is held temporarily at the partial locking position. At this partial locking position, each locking protrusion 51A, 53A, 55A, 67 is retracted before the corresponding cavity 15. Further, the groove 71 of the convex portion 70 is fit to the projection 25, as shown in FIG. 6. Fitting the groove 71 to the projection 25 in this way suppresses deflection of the thin plate 61 by its own weight to be curved and deformed.

The terminal fittings are mounted after the side retainer 50 is held at the partial locking position in this way. The medium-size terminal fitting 40 is inserted into the corresponding medium-size wire accommodating tube 17B, passed through the retainer insertion opening 30 and inserted into the cavity 15B. The convex portions 70 of the side retainer 50 are provided in the retainer insertion opening 30 and suppress having the medium-size terminal fitting 40 incline upward during the insertion of the medium-size terminal fitting 40, and the medium-size terminal fitting 40 is inserted smoothly into the cavity 15B. Further, since spaces are provided between the projections 25 and the separation wall projections 27, the posture holding portions 45 of the medium-size terminal fitting 40 can pass through. The medium-size locking lance 20 is restored and locks in the connecting portion 41 when the medium-size terminal fitting 40 is pushed to a predetermined position while deflecting and deforming the medium-size locking lance 20. Thus the medium-size terminal fitting 40 is primarily locked. The large-size and small-size terminal fittings also are inserted similarly into the corresponding wire accommodating tubes 17 and cavities 15 from behind and the large-size and small-size locking lances 19A, 19C resiliently lock to primarily lock the large-size and small-size terminal fittings.

The side retainer 50 is pushed farther from the partial locking position after all terminal fittings have been inserted, and the retainer locking portions 59 are locked at the full locking position so that the side retainer 50 is held at the full locking position. At this full locking position, each locking protrusion 51A, 53A, 55A, 67 is inserted in the corresponding cavity 15 and arranged behind the connecting portion of each terminal fitting. Thus, each terminal fitting is retained and doubly locked. Further, the grooves 71 of the convex portions 70 are fit to the separation wall projections 27. Fitting the grooves 71 to the separation wall projections 27 at the full locking position in this way suppresses having the thin plate 61 deflect by its own weight to curve and deform.

As described above, the grooves 71 are formed in the convex portions 70 provided on the thin plate 61 of the side retainer 50 and, on the other hand, the projections 25 and the separation wall projections 27 are provided respectively along an inserting direction of the side retainer 50 on the medium-size locking lances 20 and the wall surface facing the retainer insertion opening 30. As a result, the grooves 71 and the projections 25, the separation wall projections 27 are fit to each other. Thus, despite a thin and long shape of the thin plate 61, it is suppressed that the thin plate 61 is deflected to be curved and deformed.

The specification is not limited to the above described and illustrated embodiment. For example, the following mode is also included.

Although the thin plate 61 has a smaller dimension in the front-rear direction than the other parts of the side retainer 50 in the above embodiment, the thin plate 61 may have the same dimension as the other parts.

LIST OF REFERENCE SIGNS

10 . . . connector housing
11 . . . connector housing body
15 (15A to 15C) . . . cavity

20 . . . medium-size lance
25 . . . projection
27 . . . separation wall projection
30 . . . retainer insertion opening
40 . . . medium-size terminal fitting
41 . . . connecting portion
41A . . . rear edge of lower surface of connecting portion
45 . . . posture holding portion
50 . . . side retainer
51 (51R, 51L) . . . large-size terminal locking portion
53 . . . first small-size terminal locking portion
55 . . . second small-size terminal locking portion
60 . . . medium-size terminal locking portion
61 . . . thin plate
67 . . . medium-size terminal locking protrusion
70 . . . convex portion
71 . . . groove
C . . . connector

The invention claimed is:

1. A connector, comprising:

a connector housing provided with a cavity, into which a terminal fitting is to be insertable, a locking lance provided in the cavity and configured for primarily locking the terminal fitting inserted into the cavity, the connector housing being connectable to a mating connector;

a retainer insertion opening provided in a side surface of the connector housing and open in a direction intersecting with an inserting direction of the terminal fitting; and a retainer to be inserted into the retainer insertion opening to lock the terminal fitting, wherein:

the retainer includes a thin plate extending in an inserting direction of the retainer, a convex portion provided on a lower surface of the thin plate and a groove provided in the convex portion; and a projection provided on a rear end part of the locking lance in the cavity of the connector housing and being configured to fit to the groove.

2. The connector of claim 1, wherein:

the cavity is a first cavity, and the connector housing is formed with a plurality of further cavities such that terminal fittings of two or more sizes are arranged in a plurality of stages;

a rear end part of the locking lance for locking a large-size terminal fitting larger than a smallest terminal fitting projects more toward the retainer than the locking lances for locking the other terminal fittings; and a dimension of the thin plate in the inserting direction of the terminal fittings is smaller than that of other parts of the retainer in the inserting direction of the terminal fittings to avoid the locking lance for locking the large-size terminal fitting.

* * * * *